US005601302A

United States Patent [19]

Beard et al.

[11] Patent Number: 5,601,302

[45] Date of Patent: Feb. 11, 1997

[54] FULL ACCESS WHEELCHAIR

[75] Inventors: John E. Beard, Chassell, Mich.; James C. Conwell, Grove City, Pa.; Randolph C. Puls, Austin; Jeffrey C. Savela, Houston, both of Tex.; David M. Rothbauer, Holt, Mich.

[73] Assignee: Board of Supervisors of Louisiana State University and Agricultural and Mechanical College Office of Technology Transfer, Baton Rouge, La.

[21] Appl. No.: 531,465

[22] Filed: Sep. 21, 1995

Related U.S. Application Data

[63] Continuation of Ser. No. 253,624, Jun. 3, 1994, abandoned, which is a continuation of Ser. No. 789,012, Nov. 7, 1991, abandoned.

[51] Int. Cl.[6] ..... A61G 5/00

[52] U.S. Cl. ..... 280/250.1; 280/650; 297/DIG. 4

[58] Field of Search ..... 280/250.1, 42, 280/647, 650, 657, 304.1; 297/DIG. 4, 70, 337, 344.12, 344.17

[56] References Cited

U.S. PATENT DOCUMENTS

| | | | |
|---|---|---|---|
| 3,123,400 | 3/1964 | Paulson | 297/DIG. 4 |
| 3,882,949 | 5/1975 | Anderson | 280/250.1 X |
| 4,613,151 | 9/1986 | Kielczewski | 280/250.1 X |
| 4,934,723 | 6/1990 | Dysarz | 280/250.1 |
| 4,993,736 | 2/1991 | Garman et al. | 280/250.1 X |
| 5,011,175 | 4/1991 | Nicholson et al. | 280/304.1 |

*Primary Examiner*—Kevin T. Hurley
*Attorney, Agent, or Firm*—John H. Runnels; Warner J. Delaune

[57] ABSTRACT

A Full Access wheelchair in which the seat can be raised to a height of about forty inches above the ground, or lowered to a height of about ten inches above the ground, while providing constant and comfortable support for the legs of a user throughout the range of motion of the seat. This Full Access wheelchair can increase the independence of many disabled individuals, and enhance their quality of life.

5 Claims, 9 Drawing Sheets

FULL ACCESS WHEELCHAIR

This is a continuation of application U.S. Ser. No. 08/253,624 filed on Jun. 3, 1994, now abandoned which is a continuation of U.S. Ser. No. 07/789,012 filed on Nov. 7, 1991, now abandoned.

This invention pertains to an improved wheelchair, particularly to an improved wheelchair with a seat capable of raising to about 40 inches off the ground and lowering to about 10 inches off the ground, with a comfortable leg support system throughout the range of travel of the seat.

Over 40,000,000 Americans have physical disabilities, and this number is increasing as the population grows older. Many disabled individuals require the use of a wheelchair. Manual, powered, and stand-up wheelchair models are currently available commercially.

Discussions with disabled individuals confined to wheelchairs indicate frequent frustration caused by impaired independence. The simple act of grabbing an item off an upper shelf can be impossible for those in wheelchairs. These and other everyday events require assistance from others, reducing independence and self-sufficiency. The Full Access wheelchair of this invention increases independence and enhances the quality of life of the disabled individual.

The mother of a young woman confined to a wheelchair suggested that not only would the quality of her daughter's life be enhanced, but the quality of her own life would be improved as well. She responded to inquiries about the feasibility and need for a Full Access wheelchair by saying, "any device that can assist the handicapped would be welcomed; we would both enjoy the benefits." A Full Access wheelchair would reduce the young woman's dependence, and thus reduce her mother's responsibilities.

The wife of a disabled man confined to a wheelchair after an accident several years ago said that her husband had resigned himself to the fact that he was confined to a wheelchair. She was sure that he would be very interested in a wheelchair that would provide an occasional lift. Before his accident he enjoyed cooking a great deal. Unfortunately, cooking in a wheelchair is fairly difficult because of the inaccessibility of the counter, stove, and other kitchen items. She viewed a Full Access wheelchair as a means for him to enjoy cooking and other activities once again.

The manager of a retail store selling wheelchairs and related items demonstrated a wheelchair which is currently on the market, and which can provide an occasional lift by placing the occupant in a standing position. He said that while the stand-up chair was a helpful device, it still has several limitations. First, some people who use wheelchairs do not have the physical ability to use a stand-up wheelchair. They may not have legs, or their legs may be incompatible with the requirements of the stand-up chair. Second, many people who have been in wheelchairs for years experience severe discomfort when forced into the standing position. Their bodies have become accustomed to the seated position, and are incapable of a quick transition to the standing position. They may not be able to stay in the standing position for long periods of time due to the resulting unaccustomed high blood flow to the legs. Third, stand-up wheelchairs cannot provide access to low objects or the ground. Fourth, current stand-up wheelchairs cost in excess of $10,000 at retail.

U.S. Pat. No. 3,882,949 discloses a wheelchair having an adjustable-height seat, and an integral foot rest whose position changes in relation to the position of the seat. However, because the position of the foot rest continues to rotate inward when the seat is raised above the normal position, the range of upward motion of the seat is limited. The disclosure states that the raised position of the seat may go only as high as about 24–27 inches above the ground. The foot rest does not appear to be easily removable.

Other references showing the state of the art include U.S. Pat. Nos. 4,613,151; 4,685,693; 4,825,971; 4,934,723; and 4,941,540. Also of interest is U.S. Pat. No. 5,011,175 (not admitted to be prior art).

The principal object of this invention is to provide a wheelchair which allows wheelchair-bound persons the independent ability to reach high and low objects, while constantly providing a comfortable leg support system throughout the range of motion. This high-lift wheelchair should provide complete access for those confined to wheelchairs in public buildings, in shopping areas, in private businesses, and in the home. Psychological benefits should also result, clue to increased independence and "eye-to-eye" contact with others.

More specific objects of this invention are that the seat should provide variable elevation, ranging from about ten inches to about forty inches from the ground, while constantly providing a comfortable leg support system throughout the range of motion; that the overall dimensions of the wheelchair should be comparable to those of other current models of wheelchairs; and that the wheelchair should be cosmetically appealing and economically feasible.

These and other objects are achieved through the use of a double-scissor mechanism powered by a linear activator. Both the lift and drive capabilities are electrically powered. As the seat lowers toward the ground, a novel leg support system extends and rotates to maintain comfortable leg support for the user. The leg support system does not interfere with the ability to raise the level of the seat above the normal elevation.

It was determined that a preferred range of elevations for the Full Access wheelchair was from about ten inches to about forty inches above the floor. This range was determined as follows:

1) The lowest position (10"), was determined by having test subjects sit on a stack of objects. The height of the stack was adjusted until an object on the ground could easily be picked up without excessive bending at the waist. At approximately 10" all test subjects could pick up the object. This distance was also verified using standard 50th percentile dimensions for adult males and females.

2) The elevation of the seat for the normal seated position was determined through measurement of existing standard wheelchairs. In addition, the dimensions of wheelchairs were obtained from several wheelchair manufacturers' catalogs. Nearly all sources indicate that approximately 18" is the standard seat elevation.

3) The highest elevation (40") was determined by measuring the distance that can be reached by a standing person, and subtracting the distance that can be reached in the seated position. Approximately a 35" seat elevation is required for an average seated person to obtain a reach comparable to that of a standing person. An additional 5" at the highest position was added to provide even greater reach capabilities. This extra height should approximate a standing person's option of using a footstool.

Additional input on the lift and lowering dimensions was collected from 50th percentile human body models, and from physical therapists.

The overall dimensions of the Full Access wheelchair with the lift mechanism positioned at the normal seated elevation should preferably be similar to the dimensions of currently used manual and powered wheelchairs. Overall dimensions should be similar to those of standard wheelchairs for the following reasons:

1) Current public transportation vehicles, public building entrances, and public building interiors are typically designed for use with standard wheelchairs.

2) An oddly shaped or unusually dimensioned wheelchair could easily be viewed by potential customers as overly conspicuous and unattractive.

3) In general, our society (both the disabled and the non-disabled) has become accustomed to the design and dimensions of current standard wheelchairs. Significant deviation from the standard could be met with resistance from buyers and from the general public.

It is desirable that the overall design and component configuration of the wheelchair be cosmetically appealing. The lift mechanism should not be so large as to impair appearance. A totally concealed mechanism is preferred.

A double scissor mechanism was selected for raising and lowering the seat. The machining and manufacturing of the double-scissor mechanism is relatively straightforward. The simplicity of this mechanism is advantageous because it generally decreases costs.

Figure 1:
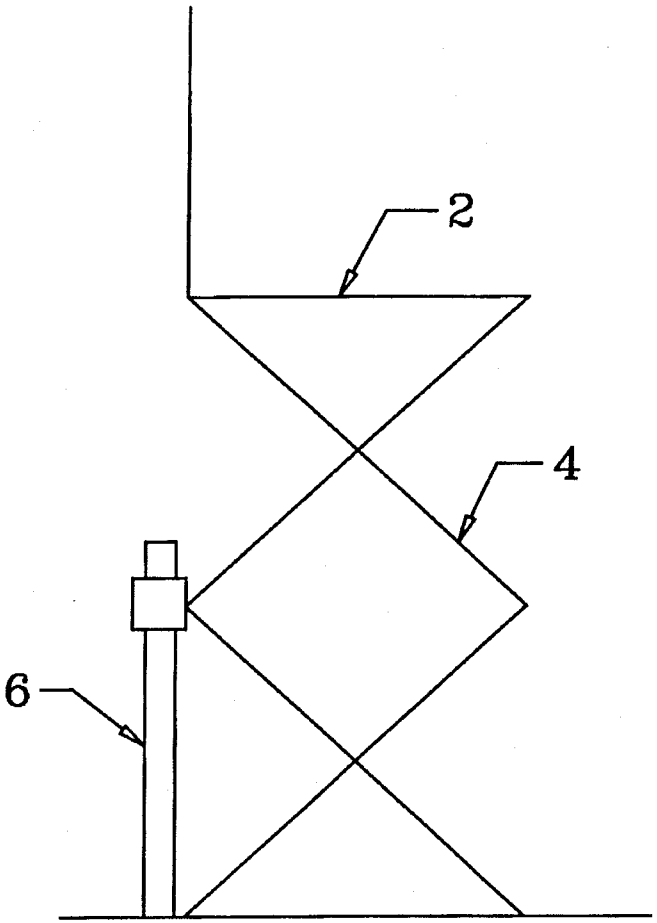
FIG. 1 illustrates schematically the preferred placement and orientation of the double-scissor mechanism.

FIG. 1 illustrates schematically the preferred placement and orientation of the double-scissor mechanism. Seat 2 is supported by double-scissor mechanism 4, which is raised and lowered by ball screw actuator 6.

Another advantage of the double-scissor mechanism is that its overall dimensions are small. When the seat 2 of the Full Access wheelchair is at the normal elevation or at its lowest elevation, the lift mechanism 4 is barely visible, as it is completely concealed under the seat. At the highest elevation the mechanism 4 is visible and could possibly be considered unattractive because of its mechanical appearance. However, the geometry and dimensions of the device easily accommodate an optional and preferred protective shroud (not illustrated). Not only does such a shroud enhance appearance, it should improve safety by inhibiting access to the mechanism.

The compact size of the double-scissor mechanism leaves sufficient space under a standard-sized wheelchair seat to accommodate a power source, drive devices, an input force device, and other associated equipment. Even with the addition of the lift mechanism, the overall dimensions of the Full Access wheelchair are similar to those of a standard wheelchair.

The symmetrical geometry of a double-scissor mechanism also enhances stability by providing a broad support beneath the seat. In addition, if there were a failure of the lifting mechanism, the seat should not fall to the ground. A preferred lifting means is a linear actuator 6. Many linear actuators, whether ball screw type or Acme thread type, are self locking. In other words, if the actuator fails, the load it carries will not move. A self-locking feature increases the safety of the double-scissor mechanism.

The two principal subsystems of the Full Access Wheelchair are the wheelchair base subsystem, and the leg support subsystem. Both subsystems are described below.

Wheelchair Base

The components of the base should be placed where they will not interfere with the seat and the lift mechanism when the seat is in its lowest position.

It is preferred that the attachments of the lift mechanism be integrated into the base (as opposed to being distinct entities), because an integrated design provides a secure, stable base, has continuity of appearance, and should cost less to manufacture than should a modular design.

Figure 2:
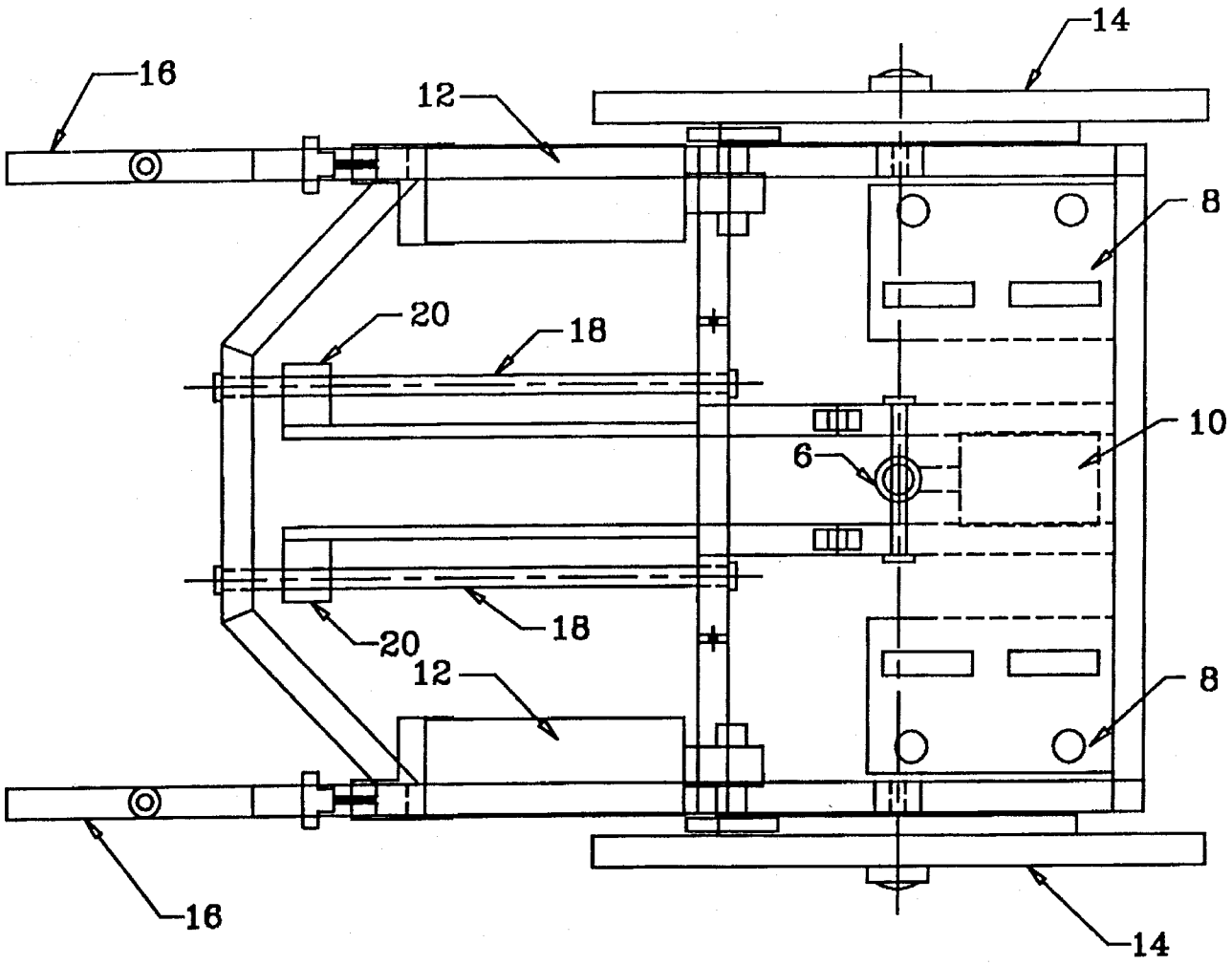
FIG. 2 illustrates the wheelchair base.

The general layout of the wheelchair base is illustrated in FIG. 2. Twelve-volt batteries 8 supply power both to actuator motor 10 and to drive motors 12. Also shown are wheels 14 and 16, slider rods 18, and linear bearings 20.

Leg Support

Figure 3A:
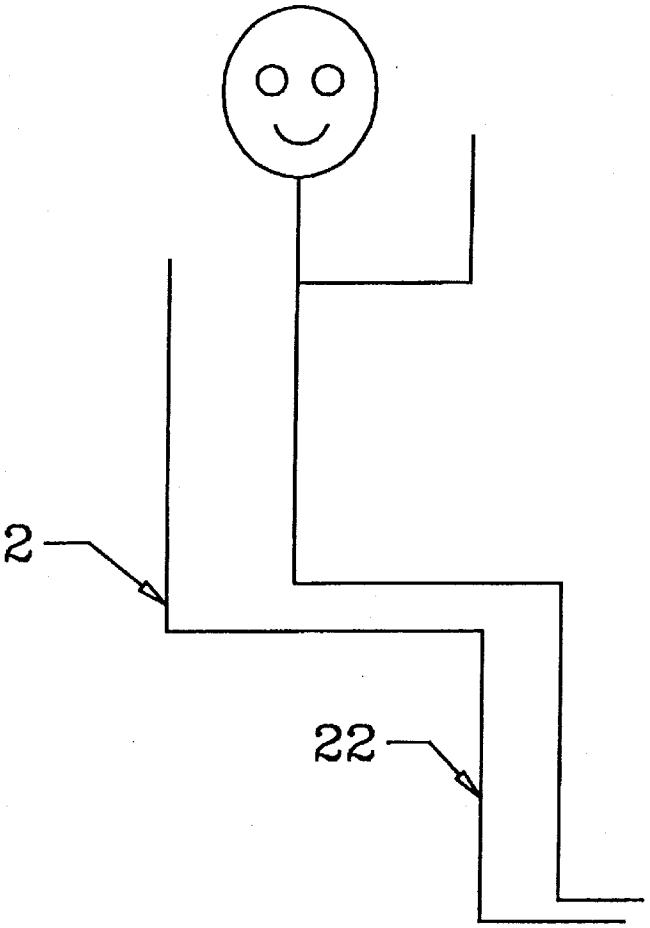
FIGS. 3A, 3B, and 3C respectively illustrate schematically the leg support in the normal seated position of a wheelchair; in a lowered position with rotation of the leg support, but with no extension; and in a lowered position with both rotation and extension of the leg support.
Figure 3B:
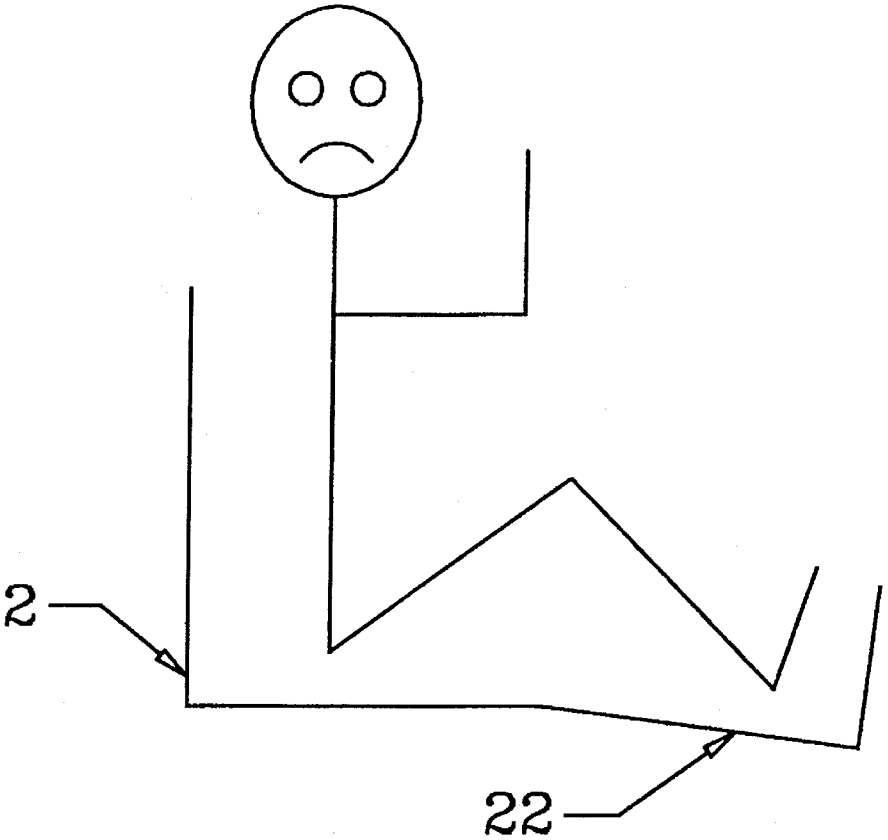
Figure 3C:
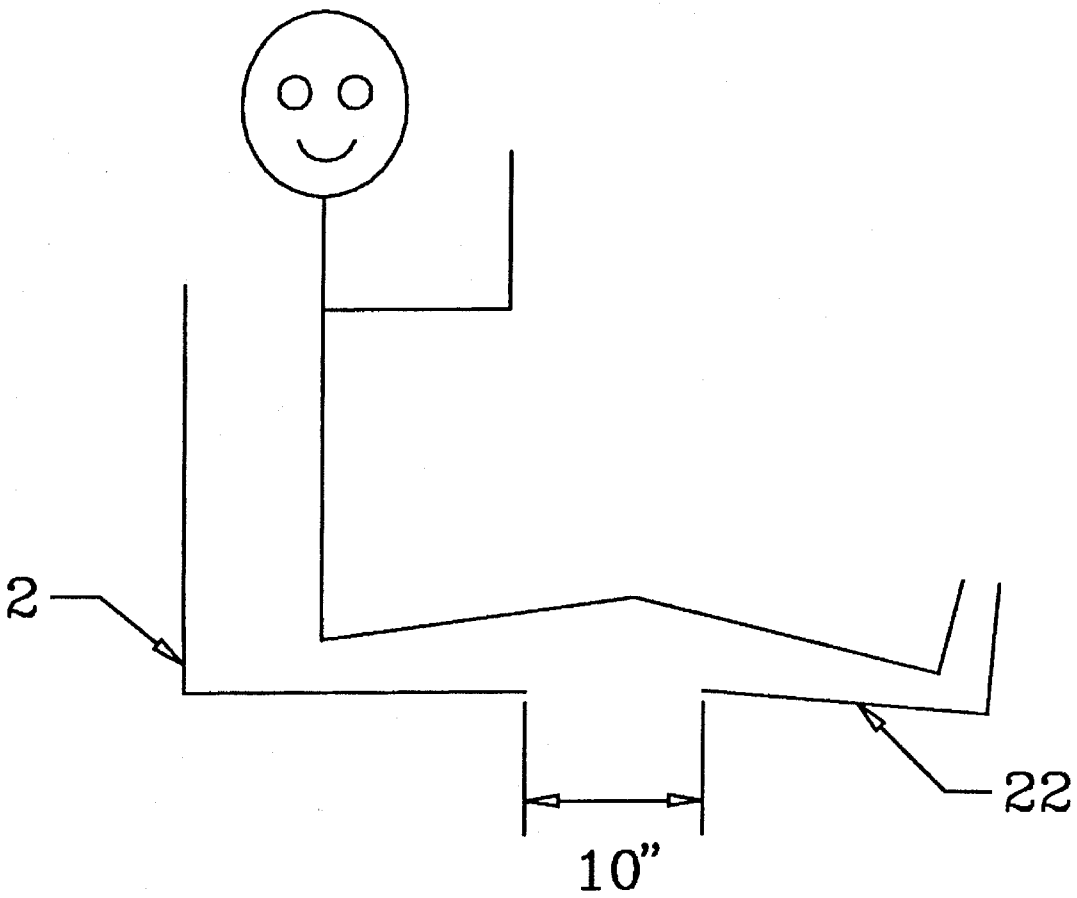

FIG. 3A illustrates schematically the position of the legs and that of a typical leg support 22 for a standard wheelchair. FIG. 3B illustrates schematically the position of the legs and the leg support if the seat were lowered, and the leg support rotated forward, but without any extension. FIG. 3B illustrates the desirability of having the leg support extend when the seat is in the lowest position. FIG. 3C illustrates schematically such an extension, preferably a total of about 10 extra inches on full extension when the seat is in its lowest position. As these figures illustrate, rotation of the leg support alone is insufficient for a comfortable posture at the lowest seat elevation. The leg support should both rotate and extend as the seat lowers from the normal position to the lowest elevation. Yet on raising the seat above the normal position, the leg support should no longer continue to rotate inward, because such continued rotation would limit the degree to which the seat could comfortably be raised above the normal seated position.

Discussions with individuals familiar with the needs of the disabled (relatives, doctors, nurses, and the disabled themselves), assisted in the identification of other design parameters and constraints associated with the leg support subsystem. First, the leg supports should be easily removable from the wheelchair. This removability is desirable because it significantly reduces the size of the wheelchair during storage and transportation. Second, the leg supports should lock securely at the desired position to provide an adequate sense of security and stability. Finally, the leg supports should rotate to the sides, out of the way of the front of the wheelchair. This rotation allows for easier entry to and exit from the wheelchair.

Figure 4:
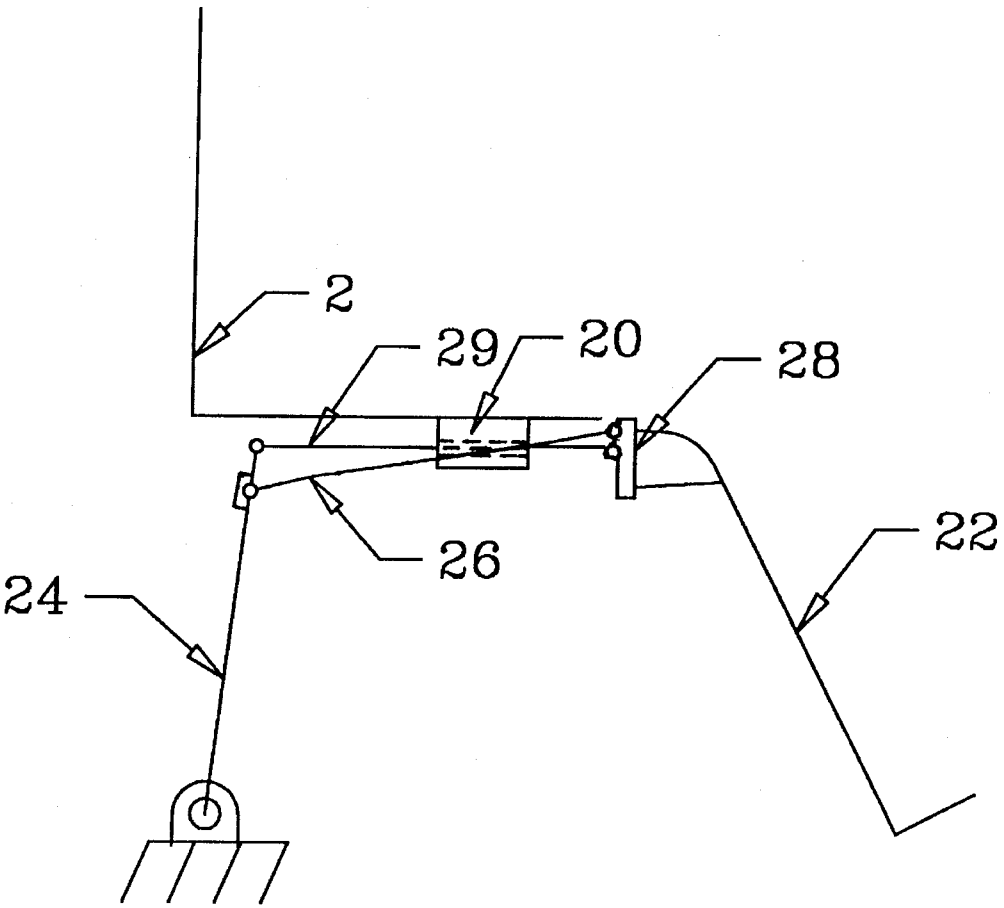
FIG. 4 illustrates schematically the leg support linkage.

The types of mechanism suitable for extending the leg support include a telescoping mechanism and a sliding mechanism. A sliding mechanism is preferred. FIG. 4 illustrates schematically the leg support linkage. When the seat lowers, extension is accomplished with telescoping push rod 24 at the end of slider rod 29. Rotational link 26 permits rotation of the assembly. The linkage is a variation of the standard four bar mechanism. The leg support 22 removably attaches to attachment bar 28.

This mechanism permits considerable latitude for adjustment. The leg support 22 can be a telescoping member to accommodate long or short legs, without affecting the slider mechanism. Extension and rotation can also be adjusted by slight repositioning of the joint locations, allowing individuals of different sizes to use the Full Access wheelchair comfortably. Note that as the seat rises above the normal position, the leg support 22 does not continue to rotate or to contract beyond its configuration when the seat is in the normal position.

An optional and preferred protective shroud (not illustrated) may be made of a corrugated, bellows-type material connected to the base and to the bottom of the seat. At below-normal seat elevations, the shroud should be barely visible. At above-normal seat elevations, the shroud will become visible, but should not be overly conspicuous if it is dark or muted in color.

Figure 5:
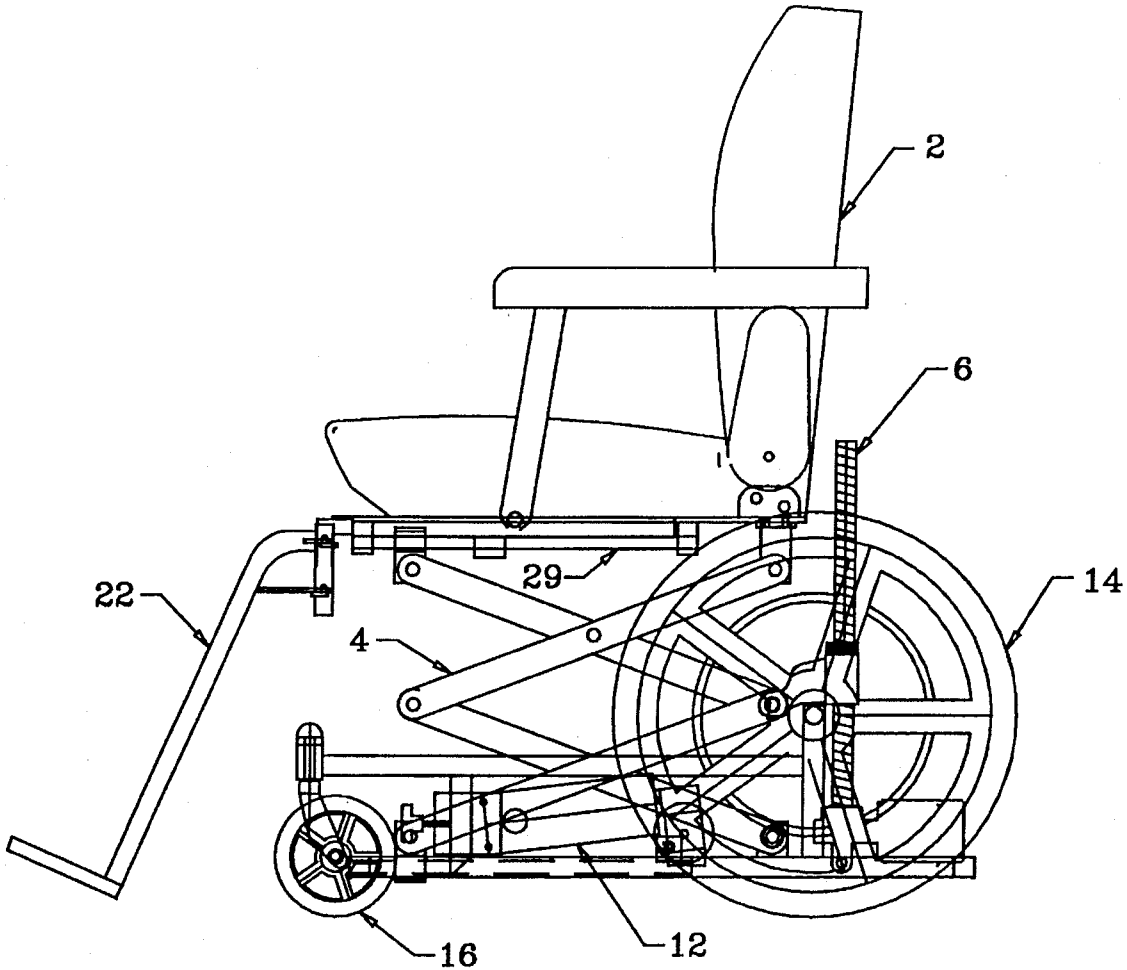
FIG. 5 illustrates the Full Access Wheelchair in the normal position.
Figure 6:
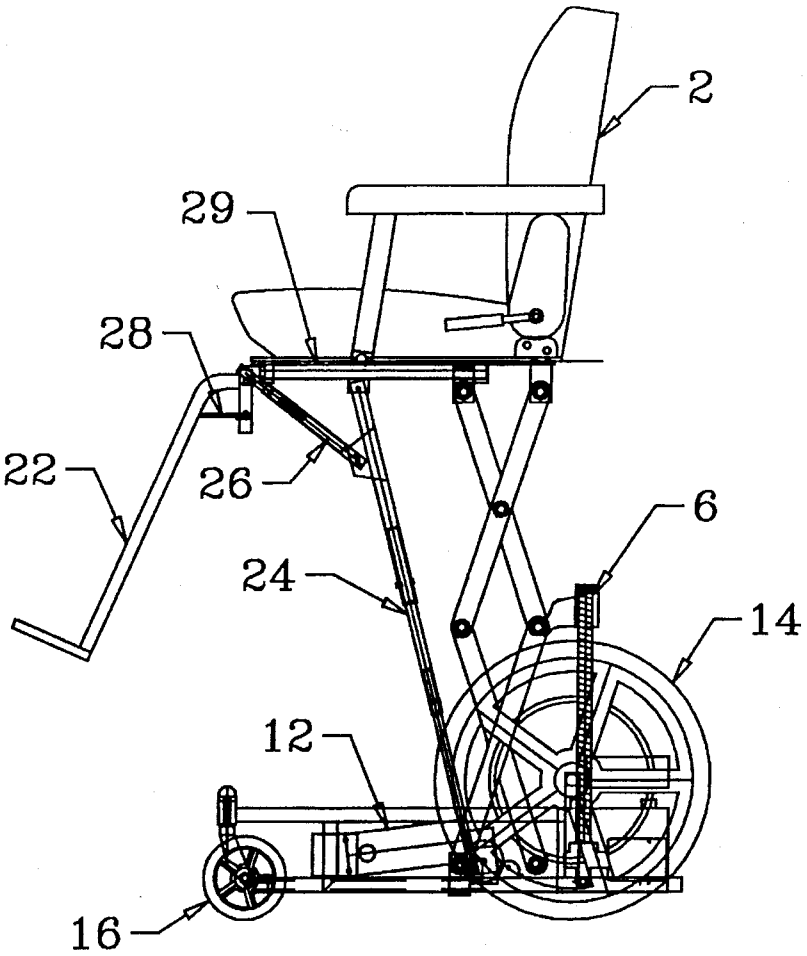
FIG. 6 illustrates the Full Access Wheelchair in an elevated position.
Figure 7:
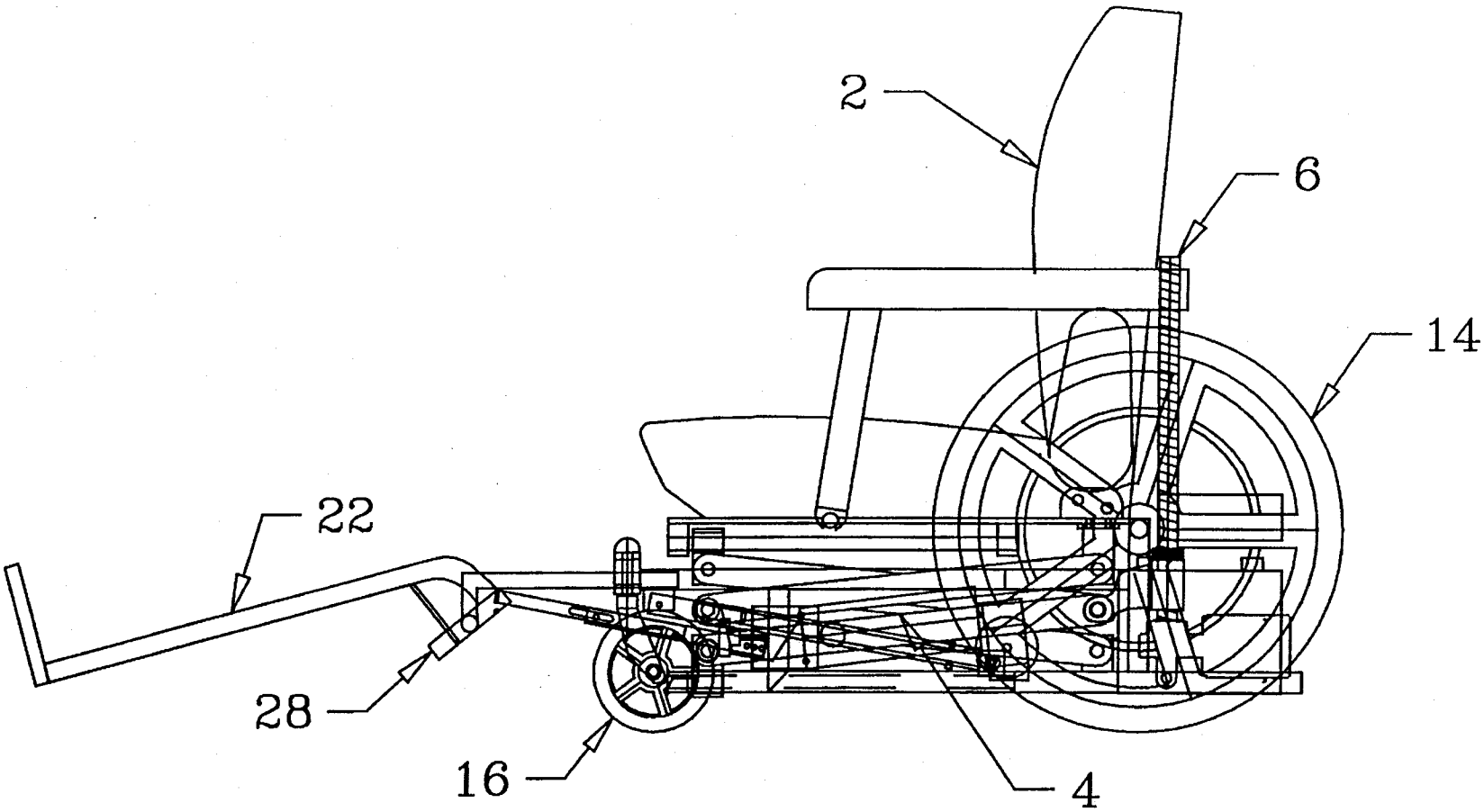
FIG. 7 illustrates the Full Access Wheelchair in a lowered position.

Overall views of the Full Access Wheelchair are illustrated in FIG. 5 (normal position), FIG. 6 (elevated position), and FIG. 7 (lowered position).

Incorporated by reference is the entire disclosure of Savela et at., "The Full Access Wheelchair," LSU student report (Dec. 5, 1990), which is not prior art.

We claim:

1. In a wheelchair having a pair of front wheels and a pair of rear wheels, said pair of front wheels and said pair of rear wheels being separated by a distance; wherein each of said wheels includes a lowest point, and wherein said lowest points define a baseplane; a seat and a pair of leg supports, said leg supports having a length and being characterized by a vertical angle between said leg supports and said baseplane; the improvement comprising:

(a) means for moving said seat to any selected height between a lowest elevation of about ten inches above said baseplane and a highest elevation of about forty inches above said baseplane;

(b) means, responsive to said moving means, for adjusting the length of said leg supports and for adjusting the vertical angle of said leg supports, to provide constant and comfortable support for the legs of a user of said wheelchair; and (c) a normal height seating configuration of said seat between said lowest elevation and said highest elevation;

wherein said adjusting means is operative when the height of said seat is below the normal height seating configuration;

wherein said adjusting means is inoperative when the height of said seat is above the normal height seating configuration; and wherein said distance between said pair of front wheels and said pair of rear wheels remains constant at all times.

2. The wheelchair as recited in claim 1, wherein said moving means comprises a double scissor mechanism.

3. The wheelchair as recited in claim 2, wherein said moving means additionally comprises a linear actuator which controls the height of said double scissor mechanism.

4. The wheelchair as recited in claim 1, wherein said adjusting means comprises a sliding mechanism operatively connected to a push rod and a rotational link.

5. The wheelchair as recited in claim 1, wherein:

(a) said moving means comprises a double scissor mechanism and a linear actuator which controls the height of said double scissor mechanism; and (b) said adjusting means comprises a sliding mechanism operatively connected to a push rod and a rotational link.

* * * * *